US005904775A

United States Patent [19]

Salo et al.

[11] Patent Number: 5,904,775

[45] Date of Patent: May 18, 1999

[54] METHOD AND DEVICE FOR APPLYING A COATING AGENT ONTO A MOVING BASE

[75] Inventors: Markku Salo, Muurame; Jorma Ramstedt, Vaajakoski; Jorma Köliö, Jyväskylä, all of Finland

[73] Assignee: Valmet Corporation, Helsinki, Finland

[21] Appl. No.: 08/772,604

[22] Filed: Dec. 23, 1996

[30] Foreign Application Priority Data

Dec. 28, 1995 [FI] Finland ..... 956296

[51] Int. Cl.[6] ..... B05C 3/02

[52] U.S. Cl. ..... 118/413; 118/118; 118/119; 118/126; 118/261; 118/262; 118/419; 29/434; 427/356

[58] Field of Search ..... 118/118, 119, 118/126, 261, 262, 413, 419; 427/356; 29/434

[56] References Cited

U.S. PATENT DOCUMENTS

| | | | |
|---|---|---|---|
| 3,416,943 | 12/1968 | Clark et al. | 117/44 |
| 3,899,999 | 8/1975 | Christ et al. | 118/405 |
| 4,250,211 | 2/1981 | Damrau et al. | 427/356 |
| 4,440,809 | 4/1984 | Vreeland | 118/413 |
| 4,836,133 | 6/1989 | Wohrle | 118/413 |
| 4,907,528 | 3/1990 | Solinger | 118/121 |
| 5,183,691 | 2/1993 | Hassell et al. | 427/286 |

FOREIGN PATENT DOCUMENTS

| | | | |
|---|---|---|---|
| 2147094 | 10/1995 | Canada . | |
| 882368 | 12/1988 | Finland . | |
| 951793 | 10/1995 | Finland . | |
| 2580681 | 10/1986 | France | 118/413 |
| 2228685 | 1/1974 | Germany . | |
| 9207551 | 10/1992 | Germany . | |

*Primary Examiner*—Peter Chin
*Assistant Examiner*—Michael P. Colaianni
*Attorney, Agent, or Firm*—Steinberg & Raskin, P.C.

[57] ABSTRACT

An applicator device for applying a coating agent onto a moving base, such as a paper or board web, onto the face of a film press roll, or equivalent, and a method for correcting for distortions arising from thermal strains in such an applicator device. The applicator device includes an applicator beam arranged in a direction transverse to a running direction of the moving base, a coating-agent feed pipe arranged in the transverse direction and mounted on the applicator beam, and coating members mounted on the applicator beam for applying a coating onto the moving base and spreading and smoothing the coating agent onto the moving base. The coating-agent feed pipe and the coating members are constructed as a single unit. The device also includes mounting members for mounting the single unit of the coating-agent feed pipe and the coating members on the applicator beam. The mounting members include a joint member coupled to the single unit and the applicator beams which permits relative movements arising from thermal expansion between the applicator beam and the single unit in the transverse direction of the machine while substantially preventing relative movements of the applicator beam and the single unit in other directions.

20 Claims, 3 Drawing Sheets

METHOD AND DEVICE FOR APPLYING A COATING AGENT ONTO A MOVING BASE

FIELD OF THE INVENTION

The invention relates to an applicator device for applying a coating agent onto a moving base, such as a paper or board web, or onto the face of a film press roll, or equivalent. The applicator device comprises an applicator beam which is placed in a direction transverse to the running direction of the moving base to be coated (the cross direction of the machine) and supports a coating-agent feed pipe placed in the cross direction of the machine and/or equivalent coating-agent feed devices as well as a coating head, a nozzle device or equivalent. The coating head or equivalent are arranged to apply, spread and smooth the coating agent onto the moving base. The invention also relates to methods for correcting distortions arising from thermal strains in an applicator device which applies a coating agent onto a moving base.

BACKGROUND OF THE INVENTION

In applicator devices which comprise an applicator beam oriented transverse to the running direction of the web, and to which beam the coating-agent coating-nozzle device, coating head or equivalent has been attached, it is a significant problem that the size, paste or equivalent coating material is fed into the nozzle device or coating head at a very high temperature, whereas normally the temperature of the applicator beam itself is substantially lower. Owing to this temperature difference, considerable bending and distortion have occurred in the applicator beam and in the nozzle device itself, in which case it has been very difficult to produce an even, uniform layer of coating agent on the moving base being coated. In the prior art, attempts have been made to solve this problem, for example, so that the temperature of the applicator beam itself has been raised considerably, whereby the difference in temperature between the applicator beam and the nozzle device has thereby been reduced considerably, and therefore the extent of bending has been lower. From the point of view of the process itself, such a solution is, however, not advantageous, because the applicator beam itself should preferably be kept at a temperature as low as possible.

It is a second solution to this problem that, in order to correct the distortion of the beam arising from tensions resulting from thermal expansion (resulting from the temperature difference), the applicator beam itself has been bent in different ways. One such solution is described, among other things, in Finnish Patent Application No. 882368, in which a measurement device is arranged inside the applicator beam so as to measure the bending of the beam, together with an aligning device by whose means the bending of the beam is corrected based on the information provided by the measurement device. Another comparable solution is described, for example, in German Utility Model Publication No. 9,207,551, in which the applicator beam is provided with a hydraulic actuator, by whose means the applicator beam is bent in order to correct the bending arising from differences in temperature. However, these prior art solutions are not very good or advanced because the emphasis has merely been mainly on correcting of the distortions arising from thermal strains, and no attention whatsoever has been paid to elimination of the thermal strains themselves. In other words, they are directed to correcting the problem after it has already arisen as opposed to avoiding the occurrence of the problem.

OBJECTS AND SUMMARY OF THE INVENTION

It is an object of the present invention to provide a solution substantially improved, compared with the prior art, for correcting the distortions arising from thermal strains in an applicator device.

It is another object of the invention to provide a new and improved method and device of applying a coating agent onto a moving base which does not involve the drawbacks of prior art coating application methods and devices.

It is yet another object of the invention to provide a new and improved method for correcting for distortions in an applicator device arising from thermal strains.

In view of achieving these objects and others, the applicator device in accordance with the present invention includes feed means for feeding a coating agent, such as a coating-agent feed pipe, and means for applying the coating agent to, and spreading and smoothing the coating agent onto, a moving base, such as a coating head or coating-agent nozzle device, which are constructed as a single unit. This single unit is mounted on the applicator beam by means of a unique joint element in order to permit relative movements arising from thermal expansion or equivalent between the applicator beam and the unit of the feed means and the coating agent applying, spreading and smoothing means in the cross direction of the machine while substantially preventing relative movements of the applicator beam and the unit in other directions.

By means of the invention, considerable advantages are obtained over the prior art, and of these advantages, for example, the following can be stated in this connection. In the invention, the coating head or the nozzle equipment, respectively, has been assembled as a separate and unified "package", which has not been attached to the applicator beam rigidly, but the mode of attaching is such that it permits different thermal elongations of the nozzle equipment and the applicator beam arising from different temperatures, in which case this difference in temperature does not cause any bending or twisting in the nozzle equipment or in the applicator beam. The gliding mode of joining in accordance with the invention also permits joining together of different materials without any problems arising in the construction from different thermal expansion coefficients of different materials in respect of the length. In such a case, the construction can be constructed, for example, so that an applicator beam made of acid-proof stainless steel is connected with a nozzle device or equivalent whose material is, for example, plastic, a plastic composite, or equivalent or in whose constructions such materials are used at least to a considerable extent. In such combination structures of different materials, of course, the forces arising from thermal expansion are problematic with conventional fixed modes of joining even if the different parts of the combination construction were at the same temperature. Thus, in the present invention, the thermal strains have been eliminated or at least substantially reduced.

Owing to the construction of the invention, the temperature of the coating agent and, therefore, also of the nozzle equipment can be raised considerably, as a result of which the adjustability and controllability of the coating process can be improved substantially. Further, it can be stated as a significant additional advantage that the carrying part of the applicator device, i.e., the applicator beam itself, can be kept as cold as possible, for example, by circulating cold water in ducts in the applicator beam alongside an inner face of the applicator beam, in which case, as a result of condensation, the outer face of the applicator beam can be made to "sweat", which again has the result that the coating agent, such as size or paste, does not adhere to the face of the applicator beam, but rather the face of the applicator beam is maintained clean.

In a basic embodiment of the invention, the feed means which feed the coating agent to coating means and the coating means are constructed as a single unit, and the device includes mounting means for mounting the single unit of the feed means and the coating means on the applicator beam. The mounting means comprise a joint member coupled to the single unit and the applicator beam and structured and arranged to permit relative movements arising from thermal expansion between the applicator beam and the single unit in the transverse direction of the machine while substantially preventing relative movements of the applicator beam and the single unit in other directions, e.g., the joint member is a glide joint that permits movement of at least a portion of the single unit engaged by the joint member only in the transverse direction of the machine. The device may include one or more support shelves fixed to the applicator beam and to which the joint member is connected. Each support shelf may be L-shaped having first and second legs, the first leg being connected to a side wall of the applicator beam and the joint member being connected to the second leg. In one specific embodiment, the joint member has a dovetail portion and a projection portion, the second leg of each support shelf has a groove receivable of the projection portion of the joint member and structured and arranged such that the joint member is rigidly attached to each support shelf. The single unit also has a frame having a groove receivable of the dovetail portion of the joint member. The single unit may comprise a frame having a lower part and a rear part whereby the feed means comprise a feed pipe situated within the frame. The lower part of the single unit is mounted to each support shelf such that the rear part of the frame is spaced from an opposed portion of the applicator beam and an air gap remains between the frame of the single unit and the applicator beam.

The invention also relates to a method for correcting distortions arising from thermal strains in an applicator device which applies a coating agent onto a moving base and includes an applicator beam arranged in a direction transverse to a running direction of the moving base, the coating agent being supplied by feed means to coating means to be applied, spread and smoothed onto the moving base through the coating means. In accordance with the invention, the method entails constructing the feed means and the coating means as a single unit, and mounting the single unit of the feed means and the coating means on the applicator beam to permit relative movements arising from thermal expansion between the applicator beam and the single unit in the transverse direction of the machine while substantially preventing relative movements of the applicator beam and the single unit in other directions, e.g., coupling the single unit and the applicator beam via a joint member. The joint member may be provided with a heat-insulation material so as to deteriorate the transfer of heat from the unit to the applicator beam.

Further advantages and characteristic features of the invention come out from the following detailed description of the invention.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
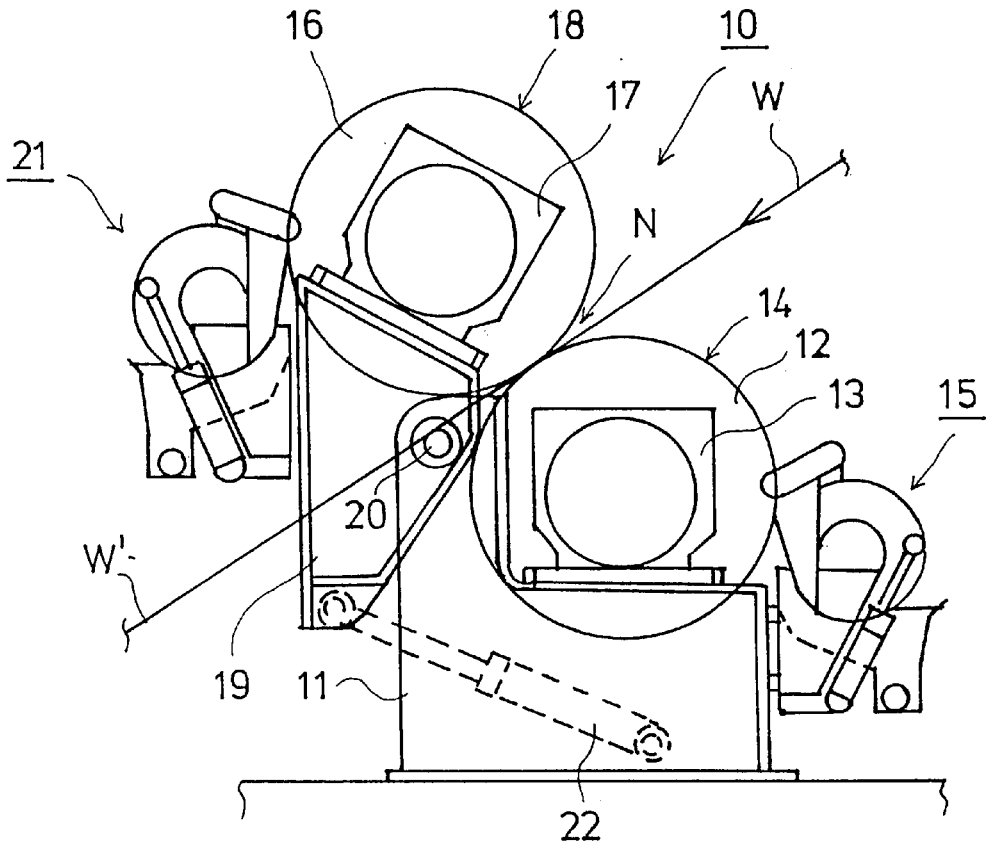
FIG. 1 is a side view of a size press or a coating device that uses the film transfer technique to which the applicator device and method in accordance with the invention can be applied.

Referring to the accompanying drawings wherein the same reference numerals refer to the same or similar elements, in FIG. 1, the size press or equivalent is denoted generally by the reference numeral 10. In the normal, conventional manner, the size press 10 comprises a frame 11 on which a pair of size press rolls 12,16 are mounted in nip-defining relationship. The size press rolls 12,16 are mounted by means of bearing housings 13,17, respectively. The bearing housing 13 of the first size press roll 12, i.e., the lower roll in the illustrated embodiment, is mounted directly on the frame 11 of the size press and fixed to the frame rigidly. On the other hand, the bearing housing 17 of the second size press roll, i.e., the upper roll in the illustrated embodiment, is mounted on a loading arm 19, which is pivotally mounted or linked by means of a pivot shaft 20 arranged in a direction transverse to the machine direction (the cross direction) on the frame 11 of the size press. Between the loading arm 19 and the size press 11, loading cylinders 22 are provided by whose means the loading arm 19 is loaded so as to produce a nip pressure of the desired magnitude in the nip N formed by the lower roll 12 and the upper roll 16. Either one of the size press rolls 12,16, preferably the upper roll 16, or, as an alternative, both of the size press rolls can be variable-crown rolls in order that the nip N pressure could be brought to the desired level in the cross direction of the machine, i.e., profiled.

Each size press roll 12,16 is provided with coating agent applicator devices 15,21 by whose means the size films or equivalent films of coating agent are applied, spread and smoothed onto faces 14,18 of the rolls 12,16, respectively. When the web W runs through the nip N, the coating-agent films are transferred from the roll 12,16 faces 14,18 to the web W to thereby provide a coated web W'. The applicator devices 15,21 shown in FIG. 1 are applicator devices in accordance with the invention, which will be described in more detail in relation to FIG. 3.

Figure 2:
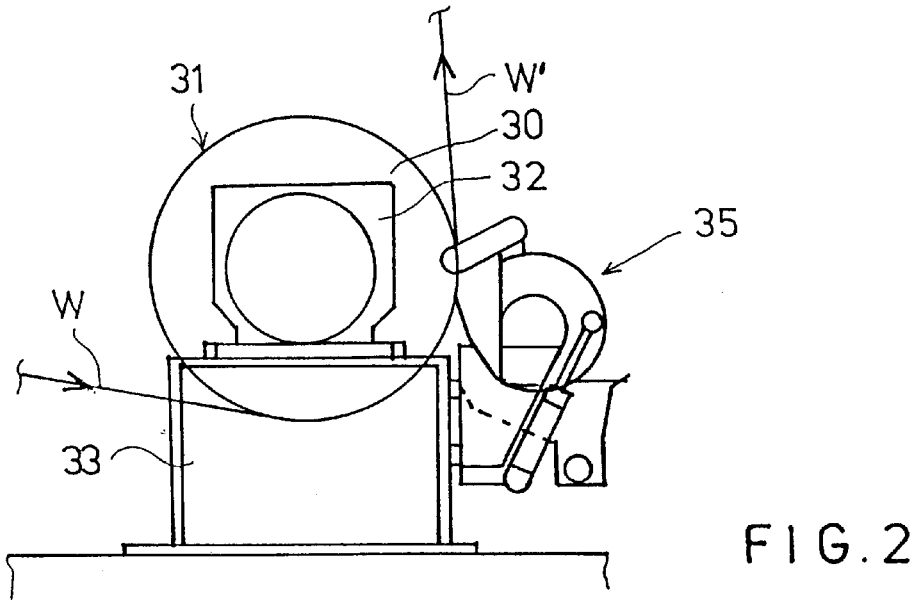
FIG. 2 is a side view of a construction in which the coating agent is spread by means of an applicator device in accordance with the invention directly onto the face of a moving paper web and can be used in the method in accordance with the invention.

FIG. 2 shows a construction of a web coating system in which the layer of coating agent is applied directly onto the face of a paper or board web W. In the embodiment of FIG. 2, the arrangement comprises a backup roll 30 arranged in connection with a bearing housing 32 which is mounted is mounted on a frame 33. The paper or board web W is passed over a certain distance along a face 31 of the backup roll 30, in which connection the coating-agent layer is spread by means of an applicator device 35 directly onto the web W. In FIG. 2, the coated web is denoted with the reference denotation W'. The embodiment of the applicator device 35 is similar to the applicator devices shown in FIG. 1, and with respect to a more detailed description reference is, also in this connection, made to FIG. 3. Thus, two different embodiments are presented in which a web is coated, i.e., either indirectly via the application of a coating to a size press roll or rolls and the subsequent transfer of the coating from the size press roll(s) to the web in a coating nip (FIG. 1) or the direct application of the coating to a web as the web runs over a backup roll (FIG. 2). The applicator device described below can of course be used in other constructions of web coating apparatus.

Figure 3:
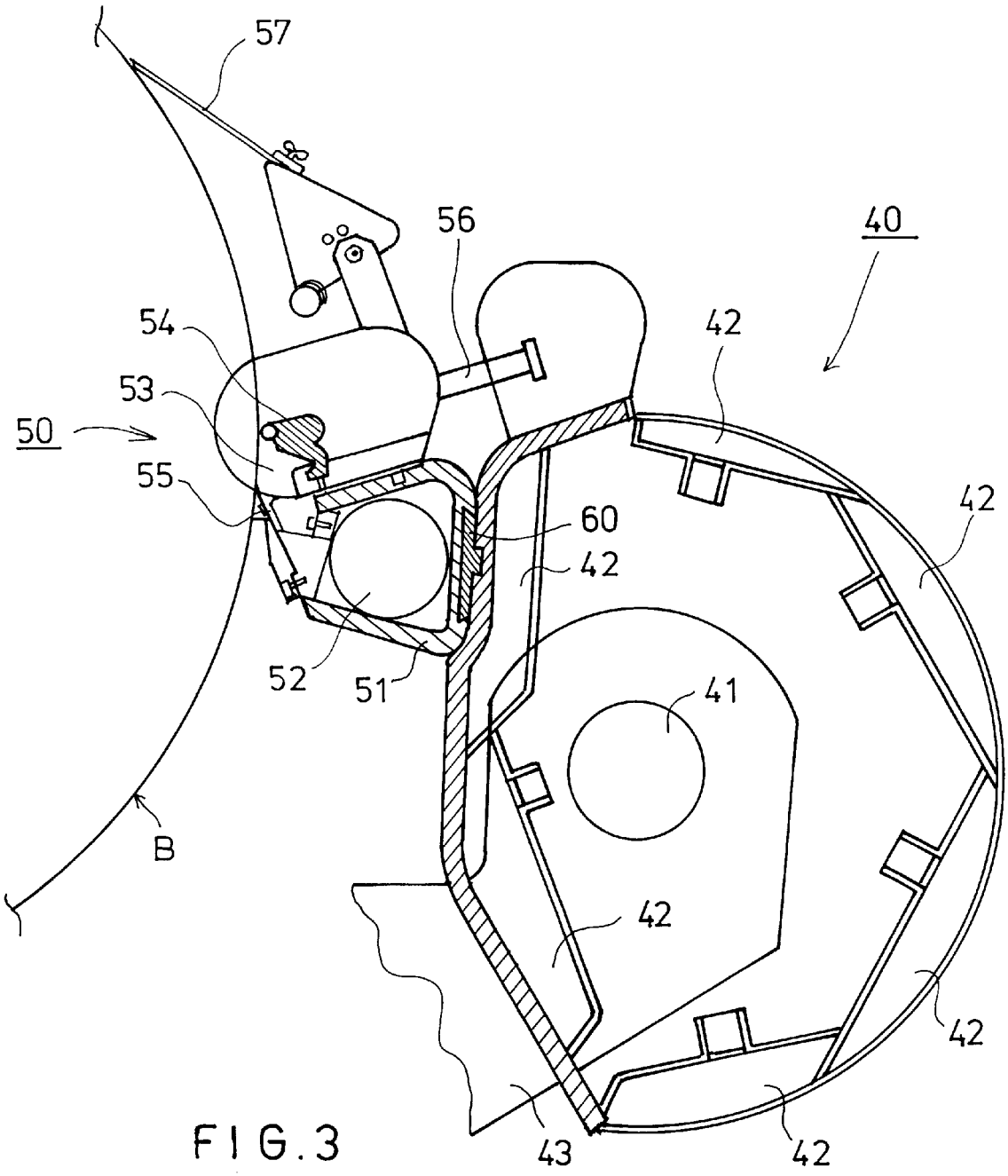
FIG. 3 is a partial sectional view of an applicator device in accordance with the invention which can be used in constructions shown in FIGS. 1 and 2.

In FIG. 3, the applicator device in accordance with the invention is illustrated schematically and comprises an applicator beam 40 pivotally mounted on frame constructions 43 of the machine in relation to an articulation shaft 41 placed in the cross direction of the machine. Further, the applicator device includes a coating-agent nozzle device, coating head or equivalent, which is denoted generally by reference numeral 50 and formed as a unified unit in a manner in accordance with the invention. The unified unit is further, in a manner in accordance with the invention described below, mounted on the applicator beam 40 by unique mounting means. The applicator beam 40 rotates about shaft 41 so that the nozzle device 50 can be moved away from the moving base B when desired. The unit that forms the nozzle device or the equivalent coating head comprises a frame 51, which includes a feed pipe 52 for a coating agent arranged therein and running in the cross direction of the machine. The coating agent may be size, paste or any other equivalent coating medium. In the illustration in FIG. 3, the unit 50 further comprises a doctor device or an equivalent coating-agent spreading member 54, which is a rod mounted revolving in a cradle in the exemplifying embodiment shown in the figure and operates to spread and smooth the coating agent on the moving base B.

Further, with reference to the exemplifying embodiment shown in FIG. 3, in this embodiment, the unit 50 comprises a coating-agent chamber 53, into which the coating agent is fed out of the feed pipe 52 and applied onto the moving base which defines the chamber in part. The front wall that defines the chamber 53 is, in FIG. 3, denoted by reference numeral 55. In this connection it should, however, be emphasized that, differing from the illustration in FIG. 3, the unit 50 can include a coating head or an equivalent nozzle device of any suitable type whatsoever, by whose means the coating agent is received from a supply thereof, e.g., the feed pipe 52, and spread and smoothed onto the moving base B, which is, in FIG. 3, for example, a face of a film press roll or a paper or board web running along the face of a backup roll. In FIG. 3, the edge doctors are denoted by reference numeral 57 and are also attached to the unit 50 at a location after the spreading member 54 in the running direction of the moving base B. Adjusting spindles for the spreading member 54 are denoted by reference numeral 56 and can be operated to provide the spreading member 54 with a desired profile.

The unit 50 that comprises the coating head or nozzle device is attached to the applicator beam 40 by means of a joint member 60 in accordance with the invention. The joint 60 shown in FIG. 6 comprises a joint piece attached to a side wall of the applicator beam 40 facing the moving base B, and a corresponding backed-off groove has been formed onto a portion of the frame 51 of the unit 50 in opposed relationship to the side wall of the applicator beam 40. Frame 51 serves as a support for the coating head or equivalent nozzle device, and in the illustrated embodiment, even houses the feed pipe 52. It is an essential feature of the joint 60 shown that it permits free thermal expansion of the unit 50 that comprises the coating head or the equivalent nozzle device, in which case no bending of the applicator beam 40 as a function of temperature takes place, i.e., when the unit 50 has a higher temperature than the temperature of the applicator beam 40. Thus, for example, the joint 60 is a glide joint which permits relative movements of the unit 50 and the applicator beam 40 in the cross direction of the machine, but which joint 60 keeps the unit 50 that comprises the coating head or the equivalent nozzle device in the other directions precisely in its position in relation to the applicator beam 40. The dovetail joint shown in FIG. 3 is highly suitable for this purpose, even though other joint modes with similar properties can also be used. Owing to the construction of the present invention, the coating agent can be passed into the feed pipe 52 and from it further onto the base B to be coated at a very high temperature, in which connection the unit 50 that includes the coating head or the equivalent nozzle device can expand freely by the effect of heat in the cross direction of the machine independently from the applicator beam 40, yet movement in other directions is substantially prevented.

If desired and/or necessary, the difference in temperature between the unit 50 that includes the coating head or the equivalent nozzle device and the applicator beam 40 can be increased further by cooling the applicator beam 40. For this purpose, in the exemplifying embodiment shown in FIG. 3, ducts 42 are formed into the applicator beam 40 for enabling a flow of cooling water. When cooling water is circulated through the ducts 42 bordering the inner face of the applicator beam, the outer face of the applicator beam 40 can be brought to a temperature substantially lower than the temperature in the environment, in which case, as a result of condensation, moisture is gathered on the face of the applicator beam 40, i.e., the applicator beam 40 starts "sweating". In such a case, the applicator beam 40 is kept clean more readily, and coating agent cannot adhere to the face of the applicator beam. In order that transfer of heat from the unit 50 that includes the coating head or the equivalent nozzle device to the applicator beam 40 can be prevented further with high efficiency, the joint area 60 can, if necessary, be made of an insulating material.

Figure 3A:
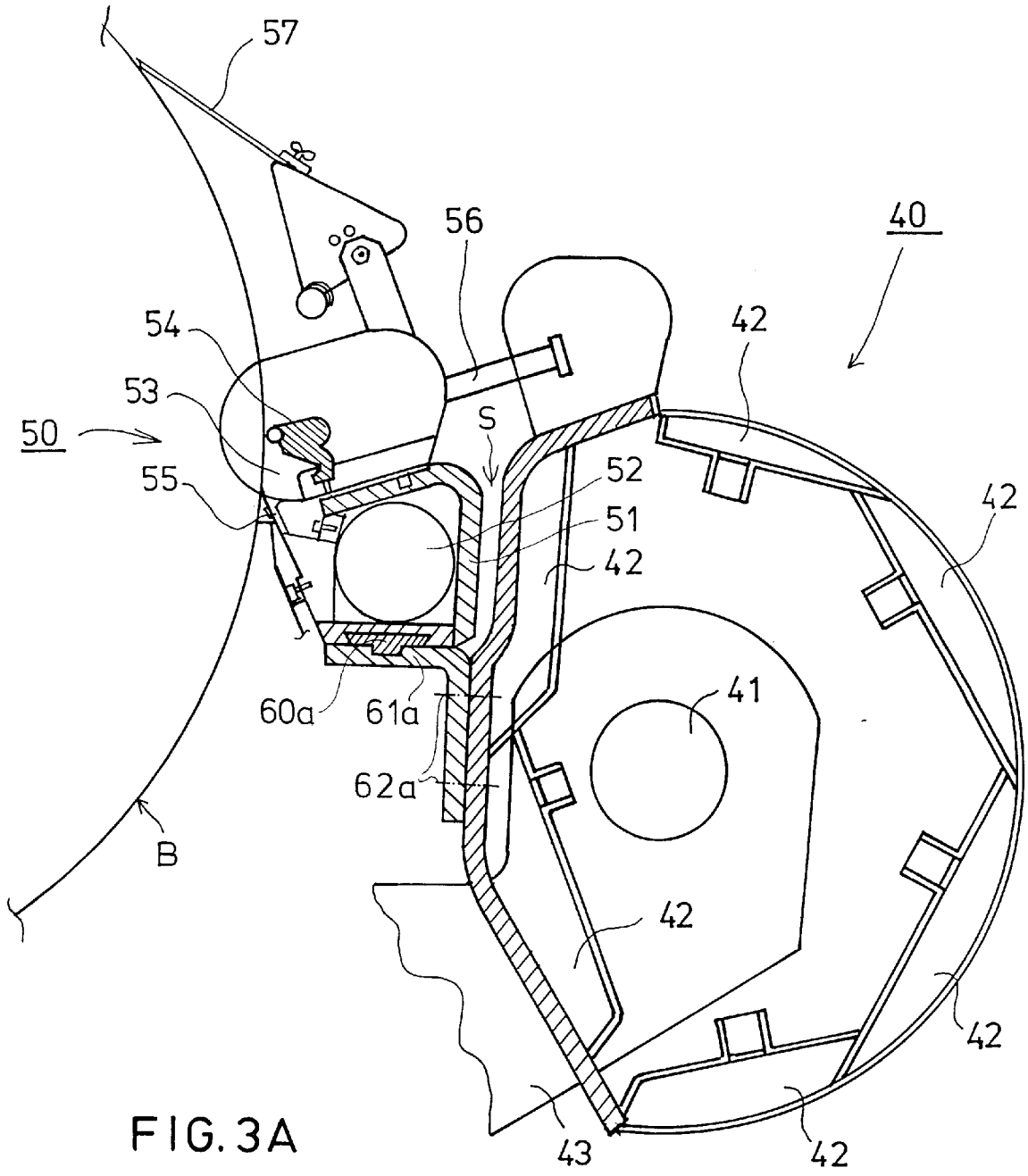
FIG. 3A is an illustration corresponding to FIG. 3 and shows an alternative embodiment of the applicator device in accordance with the invention.

In FIG. 3A, an embodiment of the invention is shown which permits the use of different materials in the applicator beam 40 and in the unit 50 that includes the coating head or the equivalent nozzle device, i.e., combining of materials with different thermal expansion coefficients into combination structures, even better. The embodiment of FIG. 3A further reduces the conduction of heat between the applicator beam 40 and the unit 50 that includes the coating head or the equivalent nozzle device. In FIG. 3A, for the parts corresponding to parts in FIG. 3, the same reference denotations have been used, and in the following the embodiment of FIG. 3A will be described in the respects only in which it differs from the embodiment of FIG. 3.

In the embodiment shown in FIG. 3A, the joint 60*a* between the applicator beam 40 and the unit 50 that includes the coating head or the equivalent nozzle device is formed so that support racks or corresponding support shelves 61*a* are fixed to the side wall of the applicator beam 40 by means of fastening members 62*a*. The fastening members 62*a* may consist of screw members or equivalent, but the fastening of the support racks or equivalent support shelves 61*a* to the wall of the applicator beam 40 can also be carried out, for example, by welding. Thus, while a portion of each support shelf is fastened to the side wall of the applicator beam 40, another portion of each support shelf 61*a* forms a horizontal support for the unit 50 that includes the coating head, which unit 50 rests on support of the support shelves 61*a*. The unit 50 is attached to the support shelves 61*a* by means of a joint 60*a*, which is, for example, a dovetail joint shown in FIG. 3A or an equivalent backed-off joint which permits movements of the pieces to be joined together in one direction, i.e., in this case, in the cross direction in relation to the machine direction, but prevents relative movements in all other directions. In the illustration in FIG. 3A, the joint 60*a* has been formed so that the joint 60*a* is attached to the support shelves 61*a*, and a groove having a corresponding shape to the joint 60*a* is formed into a lower portion of the frame 51 of the unit 50 that includes the coating head. In this respect, the arrangement can, of course, also be inverse from that shown.

FIG. 3A also shows the unit 50 that includes the coating head being installed on the support shelves 61*a* so that an air gap S remains between the unit 50 (more particularly the rear wall thereof) and the applicator beam 40 (the side wall thereof). The function of this air gap is to further reduce the conduction of heat between the unit 50 and the applicator beam.

In one preferred embodiment, the support shelves 61*a* do not extend continuously across the machine width, but they are composed of short pieces, i.e., of a plurality of shelf parts, so that there are gaps between the shelf parts in the transverse direction for further reduction of conduction of heat. Such a construction further facilitates the handling, manufacture and assembly of the parts. In other respects, the construction is similar to that shown in FIG. 3.

The examples provided above are not meant to be exclusive. Many other variations of the present invention would be obvious to those skilled in the art, and are contemplated to be within the scope of the appended claims.

We claim:

1. An applicator device for applying a coating agent onto a moving base, comprising an applicator beam arranged in a direction transverse to a running direction of the moving base, coating means for applying, spreading and smoothing the coating agent onto the moving base, feed means for supplying the coating agent to the coating means, said feed means and said coating means being constructed as a single unit, and mounting means for mounting said single unit of said feed means and said coating means on said applicator beam, said mounting means comprising a joint member coupled to said single unit and said applicator beam and arranged to permit relative movements arising from thermal expansion between said applicator beam and said single unit in the transverse direction of the machine while substantially preventing relative movements of said applicator beam and said single unit in other directions.

2. The applicator device of claim 1, wherein said joint member is a glide joint that permits movement of at least a portion of said single unit engaged by said joint member only in the transverse direction of the machine.

3. The applicator device of claim 1, further comprising at least one support shelf fixed to the applicator beam, said joint member being connected to said at least one support shelf.

4. The applicator device of claim 3, wherein said at least one support shelf is L-shaped having first and second legs, said first leg being connected to a side wall of the applicator beam and said joint member being connected to said second leg.

5. The applicator device of claim 4, wherein said joint member has a dovetail portion and a projection portion, said second leg of said at least one support shelf having a groove receivable of said projection portion of said joint member and arranged such that said joint member is rigidly attached to said at least one support shelf, said single unit having a frame having a groove receivable of said dovetail portion of said joint member.

6. The applicator device of claim 3, wherein said at least one support shelf comprises a plurality of support shelves arranged in the transverse direction of the machine such that gaps are formed between adjacent ones of said support shelves in the transverse direction.

7. The applicator device of claim 3, wherein single unit comprises a frame having a lower part and a rear part, said feed means comprising a feed pipe situated within said frame, said lower part of said single unit being mounted to said at least support shelf such that said rear part of said frame is spaced from an opposed portion of the applicator beam and an air gap remains between said frame of said single unit and the applicator beam.

8. The applicator device of claim 1, wherein said joint member has a dovetail portion and a projection portion, the applicator beam having a groove receivable of said projection portion of said joint member and arranged such that said joint member is rigidly attached to the applicator beam, said single unit having a frame having a groove receivable of said dovetail portion of said joint member.

9. The applicator device of claim 1, wherein said joint member is provided with a heat-insulation material so as to reduce the transfer of heat from said unit to the applicator beam.

10. The applicator device of claim 1, further comprising ducts arranged in an interior of the applicator beam, a medium being passed through said ducts for cooling the applicator beam.

11. The applicator device of claim 1, wherein said feed means comprise a coating-agent feed pipe extending in the direction transverse to the running direction of the moving base.

12. The applicator device of claim 1, wherein said single unit is mounted exterior of said applicator beam.

13. The applicator device of claim 1, wherein said single unit includes a frame, said mounting means being arranged to connect said frame to said applicator beam.

14. A method for correcting distortions arising from thermal strains in an applicator device which applies a coating agent onto a moving base and includes an applicator beam arranged in a direction transverse to a running direction of the moving base, the coating agent being supplied by feed means to coating means to be applied, spread and smoothed onto the moving base through said coating means, the method comprising the steps of:

constructing said feed means and said coating means as a single unit having a frame such that said feed means and said coating means are supported by said frame, and mounting said frame of said single unit of said feed means and said coating means on the applicator beam to permit relative movements arising from thermal expansion between the applicator beam and said single unit in the transverse direction of the machine while substantially preventing relative movements of the applicator beam and said single unit in other directions, said step of mounting said single unit on the applicator beams comprising the step of connecting said frame of said single unit and the applicator beam together via a joint member.

15. The method of claim 14, further comprising the step of fixing at least one support shelf to the applicator beam and connecting the joint member to said at least one support shelf.

16. The method of claim 15, wherein said at least one support shelf is L-shaped having first and second legs, further comprising the steps of connecting said first leg to a side wall of the applicator beam and connecting said joint member to said second leg.

17. The method of claim 15, wherein said at least one support shelf comprises a plurality of support shelves arranged in the transverse direction of the machine, further comprising the step of arranging said support shelves to form gaps between adjacent ones of said support shelves in the transverse direction.

18. The method of claim 14, further comprising the step of providing the joint member with a heat-insulation material so as to reduce the transfer of heat from said unit to the applicator beam.

19. An applicator device for applying a coating agent onto a moving base, comprising an applicator beam arranged in a direction transverse to a running direction of the moving base, a coating device for applying, spreading and smoothing the coating agent onto the moving base, a coating-agent supply device for supplying the coating agent to the coating device, said coating device and said supply device being constructed as a single unit, and a joint member for mounting said single unit of said coating device and said supply device on said applicator beam, said joint member being coupled to said single unit and said applicator beam and arranged to permit relative movements arising from thermal expansion between said applicator beam and said single unit in the transverse direction of the machine while substantially preventing relative movements of said applicator beam and said single unit in other directions.

20. The applicator device of claim 19, wherein said supply device comprises a coating-agent feed pipe extending in the direction transverse to the running direction of the moving base, said single unit being mounted exterior of said applicator beam.

* * * * *